US006182564B1

(12) United States Patent
Gwosdz-Kaupmann

(10) Patent No.: US 6,182,564 B1
(45) Date of Patent: Feb. 6, 2001

(54) APPARATUS AND PROCESS FOR THE SMOOTHING OF A MATERIAL WEB

(75) Inventor: Michael Gwosdz-Kaupmann, Krefeld (DE)

(73) Assignee: Voith Sulzer Papiertechnik Patent GmbH, Heidenheim (DE)

( * ) Notice: Under 35 U.S.C. 154(b), the term of this patent shall be extended for 0 days.

(21) Appl. No.: 09/338,381

(22) Filed: Jun. 23, 1999

(30) Foreign Application Priority Data

Jun. 24, 1998 (DE) ..... 198 28 156

(51) Int. Cl.[7] ..... B30B 15/34
(52) U.S. Cl. ..... 100/38; 100/156; 100/153
(58) Field of Search ..... 100/153, 38, 311, 100/312, 156, 161, 162 B; 162/358.4, 358.5, 360 R; 29/90.1, 90.2, 90.3

(56) References Cited

U.S. PATENT DOCUMENTS

| | | | | |
|---|---|---|---|---|
| 3,804,707 | * | 4/1974 | Mohr et al. | 162/358 |
| 4,308,096 | * | 12/1981 | Cronin | 162/360 R |
| 4,704,191 | * | 11/1987 | Wedel | 100/153 |
| 4,917,768 | * | 4/1990 | Ilmarinen | 100/153 |
| 4,998,333 | * | 3/1991 | Skytta | 29/130 |
| 5,137,678 | * | 8/1992 | Hess et al. | 162/136 |
| 5,163,364 | * | 11/1992 | Bubik et al. | 100/153 |
| 5,483,873 | * | 1/1996 | Koivukunnas et al. | 100/153 |
| 5,527,422 | * | 6/1996 | Lehmann et al. | 100/153 |
| 5,546,856 | | 8/1996 | Neider et al. | 100/38 |

FOREIGN PATENT DOCUMENTS

| | | |
|---|---|---|
| 6802018 | 7/1968 | (DE) . |
| 0361402 | 4/1990 | (EP) . |
| 0370185 | 5/1990 | (EP) . |
| 98/44195 | 10/1998 | (WO) . |

OTHER PUBLICATIONS

An English Language abstract of EP 0 370 185.

* cited by examiner

*Primary Examiner*—Peter Vo
*Assistant Examiner*—Louis K. Huynh
(74) *Attorney, Agent, or Firm*—Greenblum & Bernstein, P.L.C.

(57) ABSTRACT

Apparatus and process for smoothing of a material web. The apparatus includes at least one deflection adjustment roll having a soft surface, and at least one heatable endless band having a hard and smooth surface. The at least one heatable endless band is arranged into a band loop having an inner surface. At least one support surface is located within the band loop, and the at least one heatable endless band is guided over the at least one support surface. The at least one deflection adjustment roll and the at least one heatable endless band is arranged to form at least one smoothing zone adapted act on the material web. At least one heating medium supply device is positioned adjacent the inner surface and adapted to heat the inner surface and to create a liquid film for hydrodynamic lubrication between the at least one support surface and the at least one heatable endless band. The process includes positioning the at least one deflection adjustment roll and the at least one heatable endless band to form at least one smoothing zone adapted act on the material web, heating the inner surface with a heating medium, and creating, from the heating medium, a liquid film for hydrodynamic lubrication between the at least one support surface and the at least one heatable endless band.

32 Claims, 1 Drawing Sheet

APPARATUS AND PROCESS FOR THE SMOOTHING OF A MATERIAL WEB

CROSS-REFERENCE TO RELATED APPLICATIONS

The present application claims priority under 35 U.S.C. § 119 of German Patent Application No. 198 28 156.0, filed on Jun. 24, 1998, the disclosure of which is expressly incorporated by reference herein in its entirety.

BACKGROUND OF THE INVENTION

1. Field of the Invention

The present invention relates to an apparatus for the smoothing of a material web, e.g., a paper or card web. The apparatus include at least one smoothing zone through which the material web is passed.

2. Discussion of Background Information

A calender of the type generally described above is disclosed, e.g., in EP 0 361 402 A1. In this calender, the smoothing zones are respectively formed between a heated chill-cast roll and an endless band formed with a soft or resilient cover. A smoothing process of this type always occurs at a side of a material web that contacts the respective chill-cast roll. Accordingly, a relatively heavy, heated, chill-cast roll, which requires long heat up and cool down times, must be used. Moreover, the chill-cast roll is only capable of being handled with heavy apparatus.

This known calender is relatively expensive and complicated in its construction. Further, when it becomes necessary to exchange these heavy rolls, and subsequently necessary to heat the new rolls, considerable cost arises in this complex exchange. The use of a heated, chill-cast roll with corresponding bearings involves a series of disadvantages which relate, e.g., to its large mass, the long heating up and cooling down times and to the fact that corresponding handling is only possible with heavy apparatus. Thus, it is apparent that the use of rolls is extremely costly. Moreover, at least one complete replacement roll must be kept available. Further, zonal heating is not practicable due to the considerable cost which is associated with the requisite induction segments.

Finally, correspondingly high pressures and high temperatures are necessary for large rolls.

SUMMARY OF THE INVENTION

The present invention provides an apparatus of the type generally discussed above in which the above-noted disadvantages are overcome and which ensures an ideal treatment of the material web and, e.g, an ideal glazing result. Further, the construction of the apparatus is kept as simple as possible so as not to require the heavy heated hard rolls or the like of the prior art.

Accordingly, the present invention provides at least one smoothing zone formed between a deflection adjustment (controlled or compensation) roll having a soft or elastic surface and a heatable endless band of high thermal conductivity having a hard and smooth surface. The heatable endless band is guided, in the region of the smoothing zone, over a support surface arranged within the band loop, and is heated on an inner side or surface on by a heating medium. In this manner, the endless band can not only be heated, but a liquid film can be created which provides a hydrodynamic lubrication between the support surface and the endless band.

A hot gaseous medium, e.g., steam, may be preferably used as the heating medium, and the liquid film, which brings about hydrodynamic lubrication, can be expediently built up or formed by the heating medium condensing on the endless band.

As a result of this arrangement, a substantially simplified construction of a smoothing apparatus is provided without the previously customary, heavy, heated rolls, while providing ideal smoothness and gloss values. That is, ideal glazing results are ensured despite the simpler construction. While the deflection adjustment roll, which does not need to be heated, has a soft or elastic surface (or an elastic jacket or coating), the heated endless band, which is positioned on the other side of the material web, has a hard and smooth surface, so that the desired smoothing process occurs on the side web facing the heated endless band. The soft or resilient surface of the deflection adjustment roll ensures uniform compression. Through the introduction of a hot gaseous medium, e.g., steam, on the inner side of the endless band, which preferably can have a high thermal conductivity, the endless band is not only heated, but, at the same time, heating medium condensing on the inner surface forms hydrodynamic lubrication between the support surface and the endless band. Through the condensate, which is towed or dragged into the lubrication gap, a corresponding liquid film can be built up. Thus, in accordance with the features of the present invention, the gaseous medium or steam on the inner side of the endless band has a double function. Moreover, any eventually required exchange of a heatable endless band is possible with a minimum of cost and complexity.

With the heatable endless band, only a relatively small mass has to be heated or cooled in comparison with the known heated, chill-cast rolls, and no replacement rolls are required, i.e., only a replacement band, which further reduces the total cost of operation. The heating can occur at favorable cost, e.g., by steam or by another gaseous medium, and additional lubrication is not required because the condensate of the gaseous medium or steam provides such lubrication. Further, the endless band of higher thermal conductivity can be straightforwardly heated both in total, i.e., across its entire width, and also zone-wise. Zone-wise heating in particular can be possible without problems and with a minimum of cost.

While the use of a heatable endless band of high thermal conductivity is admittedly already known from EP 0 370 185 A1, this apparatus is provided with a metal band that is heated from the outside via an inductive heater. Alternatively, a non-metallic band can be acted on by steam or heated air from the outside. Moreover, in this known apparatus, both surfaces bounding a respective smoothing zone are to be heated. thus, a heated roll is required on one side of the web to be smoothed. Instead of a heated roll, a heated adjustable support element can also be used.

In a exemplary embodiment of the apparatus of the instant invention, the heatable endless band can be acted on by the heating medium upstream of the support surface in the web running direction. In this manner, timely condensation provides reliable hydrodynamic lubrication.

With a heating apparatus which is controlled zone-wise over the width of the web, by which the heatable band can be acted on by the heating medium with zone control, a further optimization of web treatment is possible. In this arrangement, the heating device can include, e.g., a zone controlled steam moistener or a steam blowing box.

In order to assist the formation of condensate, the support surface can be formed by at least one support element which is cooled, at least in the region of the support surface. A metal band can be provided, e.g., as the heatable endless band of high thermal conductivity.

In order to ensure smoothness and/or gloss values which are as ideal as possible on the acted on surface of the material web, the support surface can be expediently formed by at least one stationary support element of high rigidity. For example, a support shoe or the like can be provided as the support element.

A condensate removal device can be advantageously provided within the band loop of the heatable endless band and positioned, with respect to a web running direction, downstream of the support device. The condensate removal device can include, e.g., a removal channel with an associated doctor blade. Alternatively, or additionally, at least one suction device can also be provided. The region within the band loop can be expediently kept at ambient pressure, e.g., by a suitable vapor extraction system.

The heatable endless band can be guided over at least one band guiding roll and/or one tensioning roll.

In an expedient embodiment of the apparatus of the present invention, at least one heatable endless band having a hard and smooth surface may be simultaneously associated with a plurality of deflection controlled rolls, each having a soft or elastic surface. In this manner, the at least one heatable endless belt can form corresponding smoothing zones with each of the deflection controlled rolls.

If a plurality of smoothing zones are provided, then one surface of the material web can be placed in contact with a heatable endless band in at least one smoothing zone while the other surface of the material web can be placed in contact with a heatable endless band in at least one other smoothing zone.

The present invention relates to an apparatus for smoothing of a material web. The apparatus includes at least one deflection adjustment roll having a soft surface, and at least one heatable endless band having a hard and smooth surface. The at least one heatable endless band is arranged into a band loop having an inner surface. At least one support surface is located within the band loop, and the at least one heatable endless band is guided over the at least one support surface. The at least one deflection adjustment roll and the at least one heatable endless band is arranged to form at least one smoothing zone adapted act on the material web. At least one heating medium supply device is positioned adjacent the inner surface and adapted to heat the inner surface and to create a liquid film for hydrodynamic lubrication between the at least one support surface and the at least one heatable endless band.

In accordance with a feature of the instant invention, the at least one heating medium supply device may be adapted to supply a hot gaseous medium onto the inner surface of the at least one heatable endless band. In this manner, the liquid film for hydrodynamic lubrication is formed by condensed heating medium. Further, the hot gaseous medium can be steam.

In accordance with another feature of the present invention, the at least one heating medium supply device can be positioned, with respect to a web run direction, upstream of the at least one support surface.

According to another feature of the present invention, the at least one heating device can include a controlled zone-wise heating unit that extends over a width of the web. The heating medium may be directed onto the at least one heatable endless band is zone controllable. Further, the at least one heating device can include one of a zone-controlled steam moistener and a zone-controlled steam blowing box.

According to still another feature of the instant invention, at least one support element, which includes the at least one support surface, that is adapted to be cooled, at least in a region of the at least one support surface can be provided. In this manner, the formation of condensate is facilitated.

According to a further feature of the present invention, the at least one heatable endless band may include a metal band.

In accordance with a feature of the present invention, at least one stationary support element, which includes the at least one support surface, can be provided. Further, the at least one stationary support element may be composed of a material of high stiffness. Still further, the at least one support surface can include at least one shoe-like support element.

In accordance with a still further feature of the instant invention, at least one condensate removal device may be positioned within the at least one band loop. Further, the at least one condensate removal device may be positioned, with respect to a web run direction, downstream of the support surface. Further still, the at least one condensate removal device can include at least one removal channel. Further, the at least one condensate removal device can further include at least one doctor blade associated with the at least one removal channel.

In accordance with another feature of the present invention, the at least one condensate removal device can include at least one suction system.

According to still another feature of the present invention, the region within the band loop is kept at ambient pressure.

In accordance with a further feature of the present invention, at least one of at least one band guide roll and at least one tensioning roll may be provided, and the at least one heatable endless band can be guided over the at least one of the at least one band guiding roll and the at least one tensioning roll.

According to another feature of the instant invention, the at least one deflection adjustment roll can include a plurality of deflection adjustment rolls, and the at least one heatable endless band can be positioned to form a plurality of smoothing zones with the plurality of deflection adjustment rolls.

According to a still farther feature of the present invention, a plurality of smoothing zones can be provided and the at least one heatable endless band can include a first band and a second band. In at least one of the plurality of smoothing zones, the first band can be positioned adjacent a first surface of the web material. In this manner, the first surface can be smoothed. In at least another of the plurality of smoothing zones, the second band can be positioned adjacent a second surface of the web material, which is opposite the first surface. In this manner, the second surface can be smoothed.

In accordance with a feature of the instant invention, the material web can include one of a paper web and a cardboard web.

In accordance with another feature of the present invention, the soft surface of the at least one deflection adjustment roll may include an elastic surface.

According to still another feature of the present invention, the at least one heatable band may be composed of a material having high thermal conductivity.

The present invention relates to a process for smoothing of a material web in an apparatus that includes at least one deflection adjustment roll having a soft surface, at least one heatable endless band having a hard and smooth surface in which the at least one heatable endless band is arranged into a band loop having an inner surface, at least one support surface located within the band loop, in which the at least one heatable endless band is guided over the at least one support surface. The process includes positioning the at least one deflection adjustment roll and the at least one heatable endless band to form at least one smoothing zone adapted act on the material web, heating the inner surface with a heating medium, and creating, from the heating medium, a liquid film for hydrodynamic lubrication between the at least one support surface and the at least one heatable endless band.

In accordance with a feature of the present invention, the process further including heating the inner surface with a hot gaseous medium, and condensing the hot gaseous medium on the inner surface. In this manner, the liquid film is created. Further, the hot gaseous medium is steam.

According to another feature of the instant invention, the heating of the inner surface may include zone controlled heating of the inner surface across a width of the web.

According to another feature of the present invention, the apparatus may further include at least one support element that includes the at least one support surface, and the process can further include cooling the at least one support element in a region of the at least one support surface. In this manner, the formation of condensate can be facilitated.

In accordance with a further feature of the present invention, the at least one deflection adjustment roll may include a plurality of deflection adjustment rolls, and the process can further include positioning the plurality of deflection adjustment rolls within the at least one heatable endless band, thereby forming a plurality of smoothing zones.

In accordance with a still further feature of the present invention, the at least one deflection adjustment roll can include a plurality of deflection adjustment rolls and the at least one heatable endless band can include a first and second band. The process may further include arranging a portion of the plurality of deflection adjustment rolls within the first band to form a first plurality of smoothing zones, arranging a portion of the plurality of deflection adjustment rolls within the second band to form a second plurality of smoothing zones, and guiding the material web through the first plurality of smoothing zones and through the second plurality of smoothing zones.

According to yet another feature of the instant invention, the process may further include guiding the web material through the first plurality of smoothing zones such that the first surface of the material web can be positioned against the first band. In this manner, the first surface can be smoothed. Further, the process may include guiding the web material through the second plurality of smoothing zones such that the second surface of the material web can be positioned against the second band. In this manner, the second surface can be smoothed. Further still, the first surface can be smoothed prior to smoothing of the second surface.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
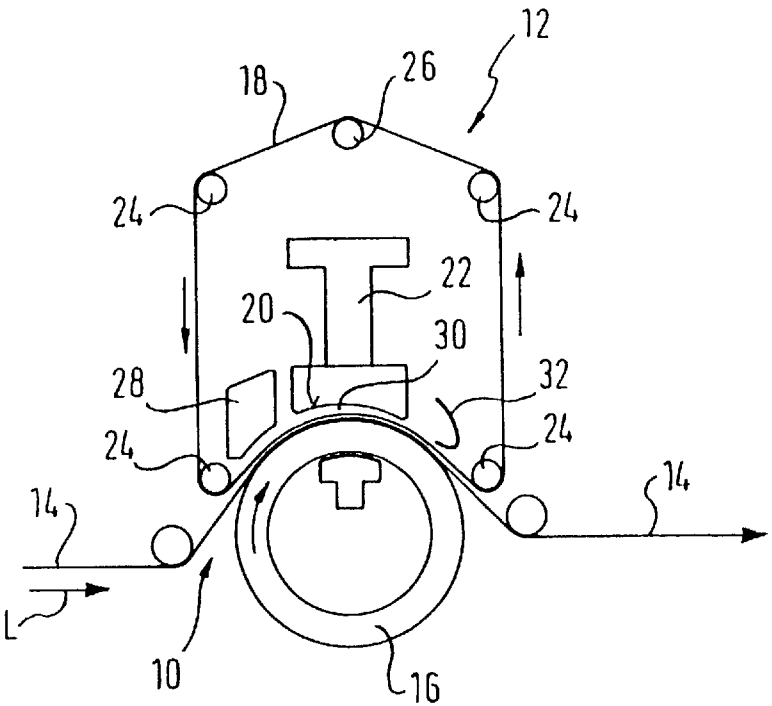
FIG. 1 schematically illustrates a smoothing zone of an apparatus for the smoothing of a material web.

FIG. 1 schematically illustrates a smoothing zone 10 of an apparatus 12 for smoothing a material web 14, e.g., a paper web or card web.

Smoothing zone 10 may be formed between a deflection adjustment (controlled) roll 16 having, e.g., an elastic jacket or elastic covering, and a recirculating endless band 18 with high thermal conductivity having a hard and smooth surface, e.g., a metal band.

In a region of smoothing zone 10, heatable endless band 18 may be guided over a support surface 20 of a fixed support element 22 of high stiffness, which is arranged to lie within the band loop. In the exemplary embodiment, support element 20 can be arranged directly above deflection adjustment roll 16 and can be of shoe-like design in its lower region with support surface 20.

Heatable endless band 18 may be guided over a plurality of band guiding rolls 24 and over a tensioning roll 26, which are arranged in an area outside of the generally vertically aligned support element 22. A heating device 28 can be arranged within the band loop formed by heatable endless band 18 such that the inner side or surface of recirculating heatable endless band 18 is acted on by a hot gaseous medium, e.g., steam, so that the endless band 18 is heated and so that a liquid film 30, which provides hydrodynamic lubrication, is formed between support surface 20 and endless band 18.

As illustrated in FIG. 1, heating device 28 can be arranged upstream of support surface 20 in web running direction L. In the present case, heating device 28 may be provided between a lower web guide roll 24 (i.e., downstream of the smoothing zone) and the shoe-like lower section of support element 22. Moreover, heating device 28 may be, e.g., a steam moistener or a steam blowing box controlled zonewise over the web width. In this manner, heatable endless band 18 can be acted on by hot gaseous medium or steam with zone control. Of course, the use of some other sectional injection device for a heated fluid is basically also conceivable.

To assist the formation of condensate, support element 22 can be cooled, e.g., at least in the region of support surface 20.

A condensate removal device 32 may be provided within the band loop of heatable endless band 18 and downstream of support surface 20 in the band travel direction L. Condensate removal device 32 can include, e.g., at least one removal channel with an associated doctor blade and/or at least one suction system. In the exemplary embodiment, the region within the band loop can be kept at environmental pressure by a suitable vapor extraction system.

Figure 2:
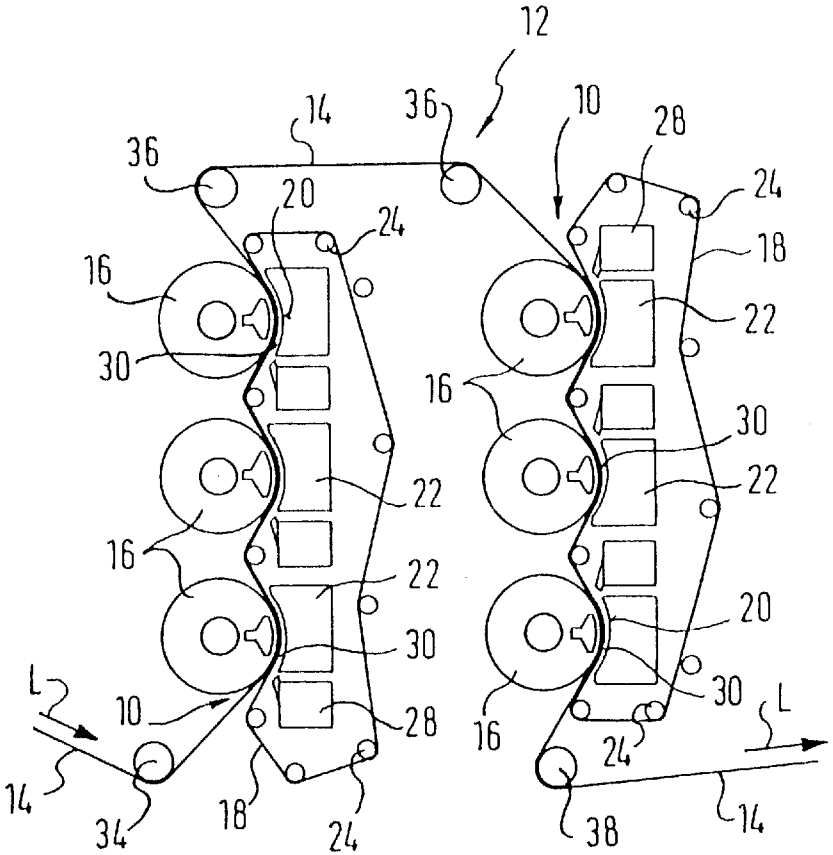
FIG. 2 schematically illustrates a further embodiment of the apparatus which includes two heatable endless bands, each of which is associated with a plurality of deflection controlled rolls.

In FIG. 2, a schematic illustration of an embodiment of a smoothing apparatus including two heatable endless bands 18 of higher thermal conductivity each having a hard and smooth surface. The two heatable endless bands 18 can be simultaneously associated with a plurality, e.g., three, deflection adjustment rolls 16 having, e.g., elastic jackets or elastic coatings. In this manner, respective smoothing zones 10 can be formed between each of the deflection controlled rolls 16 and the heatable endless bands 18. In this exemplary arrangement, each of the two heatable endless bands 18 may be supported on their inner surfaces by at least one support element 22 in a region of smoothing zone 10. A respective heating device 28 may also be provided upstream of each support element 22 so that a hot gaseous medium or steam acts on the respective heatable endless band 18. In this way, endless band 18 can be heated in the region of smoothing zone 10, and a liquid film 30 which provides hydrodynamic lubrication can be built up between support surface 20 and endless band 18. Condensate removal device 32 (see FIG. 1) or the like can also be provided within the band loops.

As shown in FIG. 2, three smoothing zones 10 may be vertically arranged one above the other, and two zone groups, which include the three vertically arranged smoothing zones, can be horizontally positioned alongside one another. In this arrangement, one heatable endless band 18 can be associated with the left-hand group of smoothing zones 10 and the other heatable endless band 18 can be associated with the other group of smoothing zones 10. In accordance with this exemplary arrangement, one surface or side of material web 14 can be in contact with the respective heatable endless band 18 of the first three vertically arranged smoothing zones 10, and the other surface of material web 14 can be in contact with the respective heatable endless band 18 associated with other three vertically arranged smoothing zones 10.

As illustrated in FIG. 2, material web 14 may be guided around a lower web guiding roll 34, generally upwardly through the first three smoothing zones 10, over two upper web guiding rolls 36, then generally downwardly through the three last smoothing zones 10, and subsequently over a lower web guiding roll 38 at the right. The two heatable, recirculating endless bands 18 can be guided over web guiding rolls 24 and at least one tensioning roll.

In the exemplary embodiment, a sectionally controllable and/or regulatable supply of heat can be supplied via heating devices 28, e.g., internal steam blowing boxes. Support surfaces 20 of support elements 22, which are provided in the band loops, can be hydrodynamically lubricated by the condensate of the relevant gaseous medium or steam. The desired smoothness process occurs at the surface of the web positioned against heatable endless band 18. Thus, in the embodiment of FIG. 2, after passing through the two zone groups with vertically arranged smoothing zones, each surface of the material web is smoothed.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

REFERENCE NUMERAL LIST

10 smoothing zone
12 smoothing apparatus
14 material web
16 deflection controlled roll
18 heatable endless band
20 support surface
22 support element
24 band guiding roll
26 tensioning roll
28 heating device
30 liquid film
32 condensate removal means
34 web guiding roll
36 web guiding roll
38 web guiding roll
L web running direction

What is claimed:

1. An apparatus for smoothing of a material web comprising:

at least one deflection adjustment roll having a soft surface;

at least one heatable endless band having a hard and smooth surface, said at least one heatable endless band being arranged into a band loop having an inner surface;

at least one support surface located within the band loop, and said at least one heatable endless band being guided over said at least one support surface;

said at least one deflection adjustment roll and said at least one heatable endless band being arranged to form at least one smoothing zone structured and arranged to act on the material web; and at least one heating medium supply device positioned adjacent said inner surface and adapted to heat said inner surface and to create a liquid film for hydrodynamic lubrication between said at least one support surface and said at least one heatable endless band.

2. The apparatus in accordance with claim 1, said at least one heating medium supply device is positioned, with respect to a web run direction, upstream of said at least one support surface.

3. The apparatus in accordance with claim 1, said at least one heating device comprising a controlled zone-wise heating unit extending over a width of the web, wherein said heating medium directed onto said at least one heatable endless band is zone controllable.

4. The apparatus in accordance with claim 1, further comprising at least one support element, which includes said at least one support surface, wherein said at least one support element is structured and arranged to be cooled at least in a region of said at least one support surface, whereby a formation of condensation of the heating medium is facilitated.

5. The apparatus in accordance with claim 1, said at least one heatable endless band comprising a metal band.

6. The apparatus in accordance with claim 1, further comprising at least one stationary support element, which includes said at least one support surface.

7. The apparatus in accordance with claim 6, said at least one stationary support element being composed of a material of high stiffness.

8. The apparatus in accordance with claim 6, said at least one support surface comprising at least one shoe-like support element.

9. The apparatus in accordance with claim 1, further comprising at least one condensate removal device positioned within the at least one band loop.

10. The apparatus in accordance with claim 9, said at least one condensate removal device being positioned, with respect to a web run direction, downstream of the support surface.

11. The apparatus in accordance with claim 9, said at least one condensate removal device comprising at least one removal channel.

12. The apparatus in accordance with claim 11, said at least one condensate removal device further comprising at least one doctor blade associated with said at least one removal channel.

13. The apparatus in accordance with claim 9, said at least one condensate removal device comprising at least one suction system.

14. The apparatus in accordance with claim 1, wherein the region within the band loop is kept at ambient pressure.

15. The apparatus in accordance with claim 1, further comprising at least one of at least one band guide roll and at least one tensioning roll; and said at least one heatable endless band being guided over said at least one of said at least one band guiding roll and said at least one tensioning roll.

16. The apparatus in accordance with claim 1, said at least one deflection adjustment roll comprising a plurality of deflection adjustment rolls; and said at least one heatable endless band being positioned to form a plurality of smoothing zones with said plurality of deflection adjustment rolls.

17. The apparatus in accordance with claim 1, further comprising a plurality of smoothing zones and said at least one heatable endless band comprising a first band and a second band, wherein in at least one of the plurality of smoothing zones, said first band is positioned adjacent a first surface of the web material, whereby said first surface is smoothed, and wherein in at least another of the plurality of smoothing zones, said second band is positioned adjacent a second surface of the web material, which is opposite said first surface, whereby said second surface is smoothed.

18. The apparatus in accordance with claim 1, wherein the material web comprises one of a paper web and a cardboard web.

19. The apparatus in accordance with claim 1, said soft surface of said at least one deflection adjustment roll comprising an elastic surface.

20. The apparatus in accordance with claim 1, said at least one heatable band being composed of a material having high thermal conductivity.

21. An apparatus for smoothing of a material web comprising:

at least one deflection adjustment roll having a soft surface;

at least one heatable endless band having a hard and smooth surface, said at least one heatable endless band being arranged into a band loop having an inner surface;

at least one support surface located within the band loop, and said at least one heatable endless band being guided over said at least one support surface;

said at least one deflection adjustment roll and said at least one heatable endless band being arranged to form at least one smoothing zone structured and arranged to act on the material web;

at least one heating medium supply device positioned adjacent said inner surface and adapted to heat said inner surface and to create a liquid film for hydrodynamic lubrication between said at least one support surface and said at least one heatable endless band; and said at least one heating medium supply device is adapted to supply a hot gaseous medium onto said inner surface of said at least one heatable endless band, whereby said liquid film for hydrodynamic lubrication is formed by condensed heating medium.

22. The apparatus in accordance with claim 21, said hot gaseous medium being steam.

23. An apparatus smoothing of a material web comprising:

at least one deflection adjustment roll having a soft surface;

at least one heatable endless band having a hard and smooth surface, said at least one heatable endless band being arranged into a band loop having an inner surface;

at least one support surface located within the band loop, and said at least one heatable endless band being guided over said at least one support surface;

said at least one deflection adjustment roll and said at least one heatable endless band being arranged to form at least one smoothing zone structured and arranged to act on the material web;

at least one heating medium supply device positioned adjacent said inner surface and adapted to heat said inner surface and to create a liquid film for hydrodynamic lubrication between said at least one support surface and said at least one heatable endless band;

said at least one heating device comprising a controlled zone-wise heating unit extending over a width of the web, wherein said heating medium directed onto said at least one heatable endless band is zone controllable; and said at least one heating device comprising one of a zone-controlled steam moistener and a zone-controlled steam blowing box.

24. A process for smoothing of a material web in an apparatus that includes at least one deflection adjustment roll having a soft surface, at least one heatable endless band having a hard and smooth surface in which the at least one heatable endless band is arranged into a band loop having an inner surface, at least one support surface located within the band loop, in which the at least one heatable endless band is guided over said at least one support surface, the process comprising:

positioning said at least one deflection adjustment roll and said at least one heatable endless band to form at least one smoothing zone adapted to act on the material web;

heating the inner surface with a heating medium; and creating, from the heating medium, a liquid film for hydrodynamic lubrication between the at least one support surface and the at least one heatable endless band.

25. The process in accordance with claim 24, the heating of the inner surface comprising zone controlled heating of the inner surface across a width of the web.

26. The process in accordance with claim 24, wherein the apparatus further includes at least one support element that includes the at least one support surface, and the process further comprises cooling the at least one support element in a region of the at least one support surface, whereby the formation of condensate is facilitated.

27. The process in accordance with claim 24, wherein the at least one deflection adjustment roll includes a plurality of deflection adjustment rolls, and the process further comprises:

positioning the plurality of deflection adjustment rolls and the at least one heatable endless band, thereby forming a plurality of smoothing zones.

28. The process in accordance with claim 24, wherein the at least one deflection adjustment roll includes a plurality of deflection adjustment rolls and the at least one heatable endless band includes a first and second band, and the process further comprises:

arranging a portion of the plurality of deflection adjustment rolls and the first band to form a first plurality of smoothing zones;

arranging a portion of the plurality of deflection adjustment rolls and the second band to form a second plurality of smoothing zones; and guiding the material web through the first plurality of smoothing zones and through the second plurality of smoothing zones.

29. The process in accordance with claim 28, further comprising:

guiding the web material through the first plurality of smoothing zones such that the first surface of the material web is positioned against the first band, whereby the first surface is smoothed; and guiding the web material through the second plurality of smoothing zones such that the second surface of the material web is positioned against the second band, whereby the second surface is smoothed.

30. The process in accordance with claim 29, wherein the first surface is smoothed prior to smoothing of the second surface.

31. A process for smoothing of a material web in an apparatus that includes at least one deflection adjustment roll having a soft surface, at least one heatable endless band having a hard and smooth surface in which the at least one heatable endless band is arranged into a band loop having an inner surface, at least one support surface located within the band loop, in which the at least one heatable endless band is guided over said at least one support surface, the process comprising:

positioning said at least one deflection adjustment roll and said at least one heatable endless band to form at least one smoothing zone adapted to act on the material web;

heating the inner surface with a heating medium; and creating, from the heating medium, a liquid film for hydrodynamic lubrication between the at least one support surface and the at least one heatable endless band;

heating the inner surface with a hot gaseous medium; and condensing the hot gaseous medium on the inner surface, whereby the liquid film is created.

32. The process in accordance with claim 31, wherein the hot gaseous medium is steam.

* * * * *